US006941959B2

(12) United States Patent
Kung-Tai

(10) Patent No.: US 6,941,959 B2
(45) Date of Patent: Sep. 13, 2005

(54) UMBRELLA HAVING WIND PRESSURE RELEASING DEVICE

(76) Inventor: Liang Kung-Tai, No. Lunmei Rd., Changhua City (TW)

( * ) Notice: Subject to any disclaimer, the term of this patent is extended or adjusted under 35 U.S.C. 154(b) by 0 days.

(21) Appl. No.: 10/722,524

(22) Filed: Nov. 28, 2003

(65) Prior Publication Data

US 2005/0072453 A1 Apr. 7, 2005

(30) Foreign Application Priority Data

Oct. 7, 2003 (TW) ..... 92217963 U

(51) Int. Cl.[7] ..... A45B 25/22; A45B 25/02
(52) U.S. Cl. ..... 135/33.7; 135/29; 135/32
(58) Field of Search ..... 135/33.7, 29, 32

(56) References Cited

U.S. PATENT DOCUMENTS 6,173,724 B1 * 1/2001 You ..... 135/33.7
6,502,592 B2 * 1/2003 Chen ..... 135/33.7
6,601,597 B2 * 8/2003 Sung ..... 135/33.7

* cited by examiner

*Primary Examiner*—Robert Canfield
(74) *Attorney, Agent, or Firm*—Rosenberg, Klein & Lee

(57) ABSTRACT

An umbrella includes a shaft with a runner movably mounted thereto and a first cap and a second cap are respectively connected to a top end of the shaft. The first cap is located closer than the second cap to the second end of the shaft. A plurality of first ribs pivotably connected to the second end cap and a main panel is mounted to the first ribs. The main panel has a hole with a center at the shaft. Each first rib has a join connected thereto and each joint having a first passage through which the first rib extends and a second passage through which one of second ribs extends. Each second rib has a first end thereof pivotably connected to the first cap and a section of the second end of each of the second ribs is overlapped on the main panel. A sub-panel is attached to the second ribs and covers the hole in the main panel. A plurality of stretchers are pivotably connected between the runner and the joints.

4 Claims, 9 Drawing Sheets

UMBRELLA HAVING WIND PRESSURE RELEASING DEVICE

FIELD OF THE INVENTION

The present invention relates to an umbrella having a hole in a center of the main panel and a plurality sub-ribs to the shaft and covered by a sub-panel to close the hole so as to release wind flows through the gaps between the two panels.

BACKGROUND OF THE INVENTION

A conventional umbrella is shown in FIG. 1 and generally includes a shaft having a runner 6 movably mounted to the shaft 1 and a cap 61 is fixed to a top end of the shaft 1. A plurality of ribs 3 are pivotably connected to the cap 61 and a panel 4 is fixedly spread on the ribs 3. Each rib 3 includes a joint 5 connected to a mediate portion thereof and a plurality of stretchers 2 are pivotably connected to the runner 6 and the joints 5 such that when moving the runner toward the cap 61, the panel 4 is stretched outward by the stretchers 2. An inherent shortcoming of the conventional umbrella is hat when wind comes below the panel 4 and goes upward, the remote ends of the ribs 3 cannot stand the force caused by the pressure of the wind and bend upward about the joints 5. This suddenly reduces the area that the panel 4 covers and could damage the joints 5 and the ribs 3.

The present invention intends to provide an umbrella that has a pressure releasing device so as to release the pressure of the wind no matter which direction the wind flows.

SUMMARY OF THE INVENTION

The present invention relates to an umbrella comprising a shaft having a runner movably mounted thereto and a first cap and a second cap are connected to a top end of the shaft. The first cap is located closer than the second cap to the second end of the shaft. A plurality of first ribs each have a first end pivotably connected to the second end cap and each first rib has a join connected thereto. Each joint has a first passage and a second passage. The first ribs extend through the first passages of the joints and a main panel is attached to the first ribs and has a hole with a center at the shaft. A plurality of second ribs each have a first end thereof pivotably connected to the first cap and a second end of each of the second ribs movably extends through the second passage of each of the joints. A section of the second end of each of the second ribs is overlapped on the main panel and a sub-panel is attached to the second ribs and covers the hole in the main panel. A plurality of stretchers are pivotably connected between the runner and the joints.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
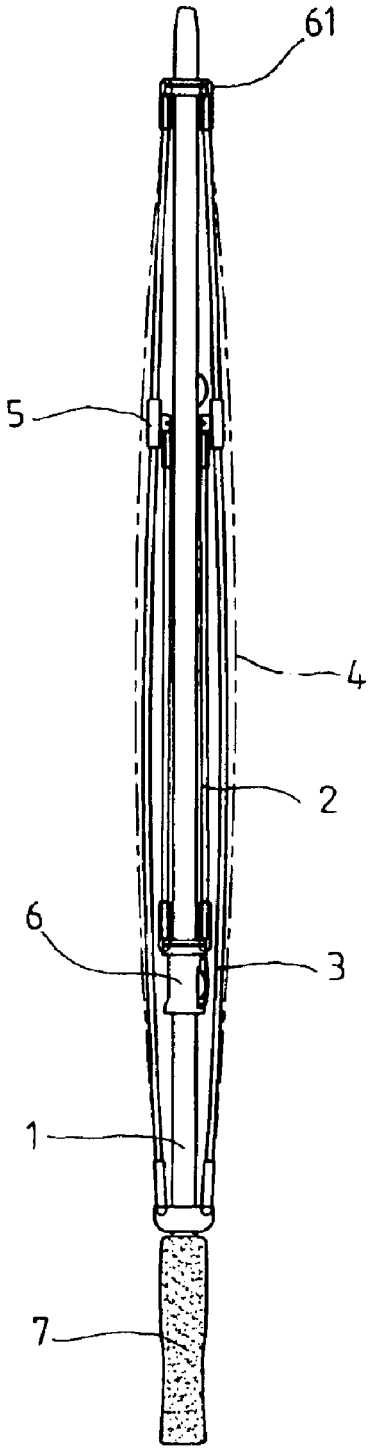
FIG. 1 PRIOR ART
FIG. 1 shows a conventional umbrella in a folded status.
Figure 2:
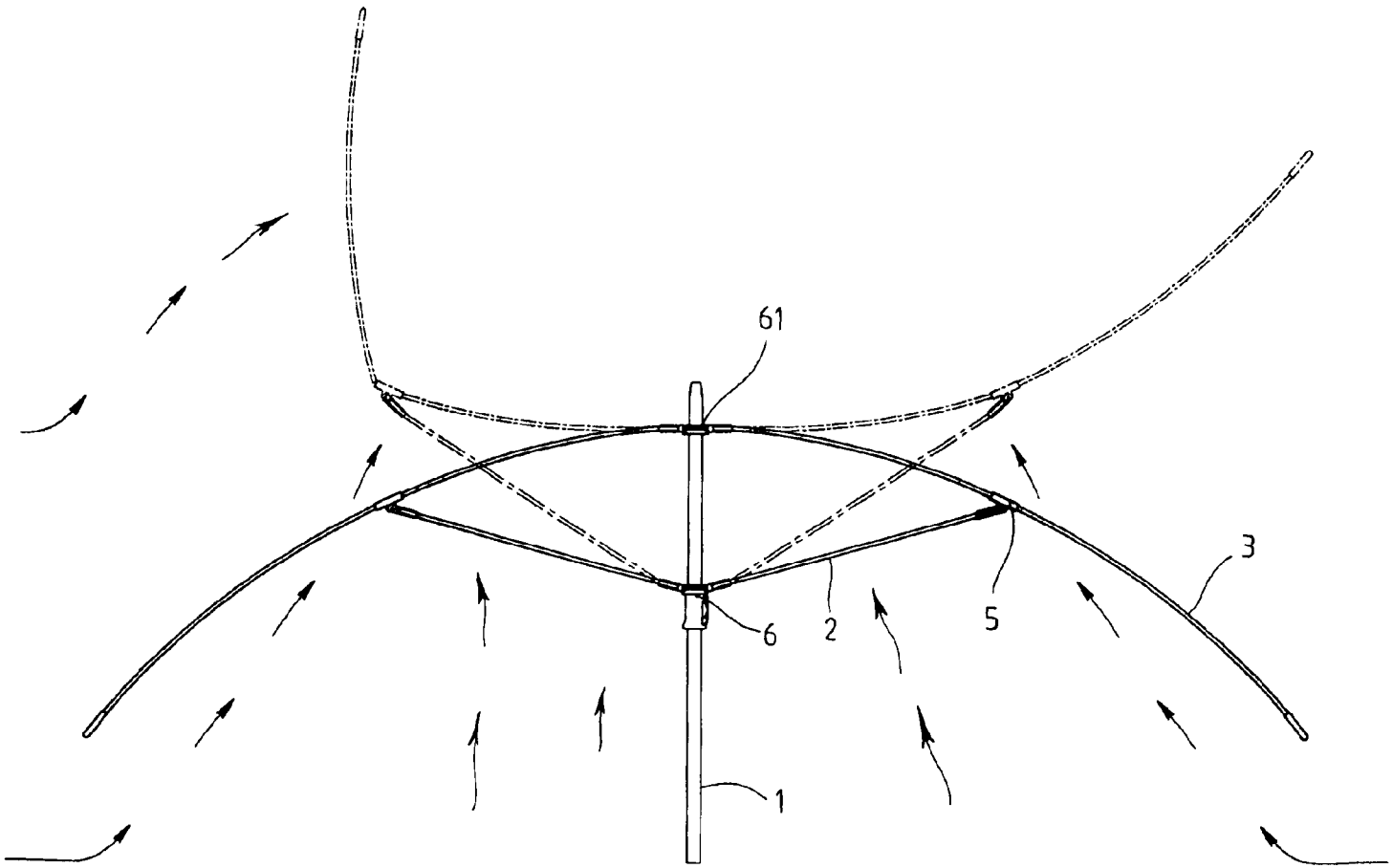
FIG.2 PRIOR ART
FIG. 2 shows the ribs of the conventional umbrella are bent upward by the wind.
Figure 3:
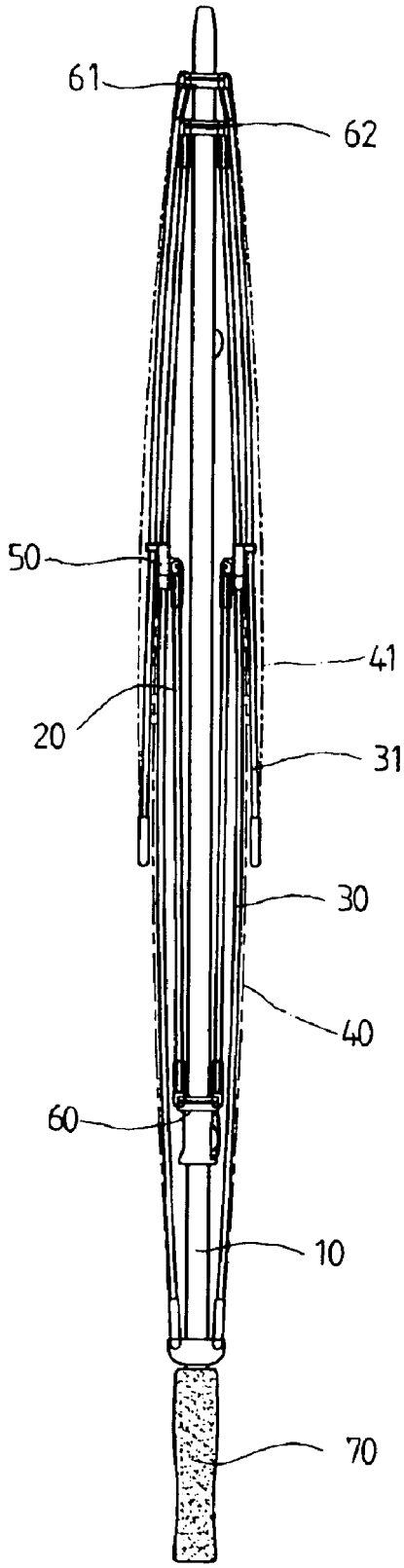
FIG. 3 shows the umbrella of the present invention in a folded status.
Figure 4:
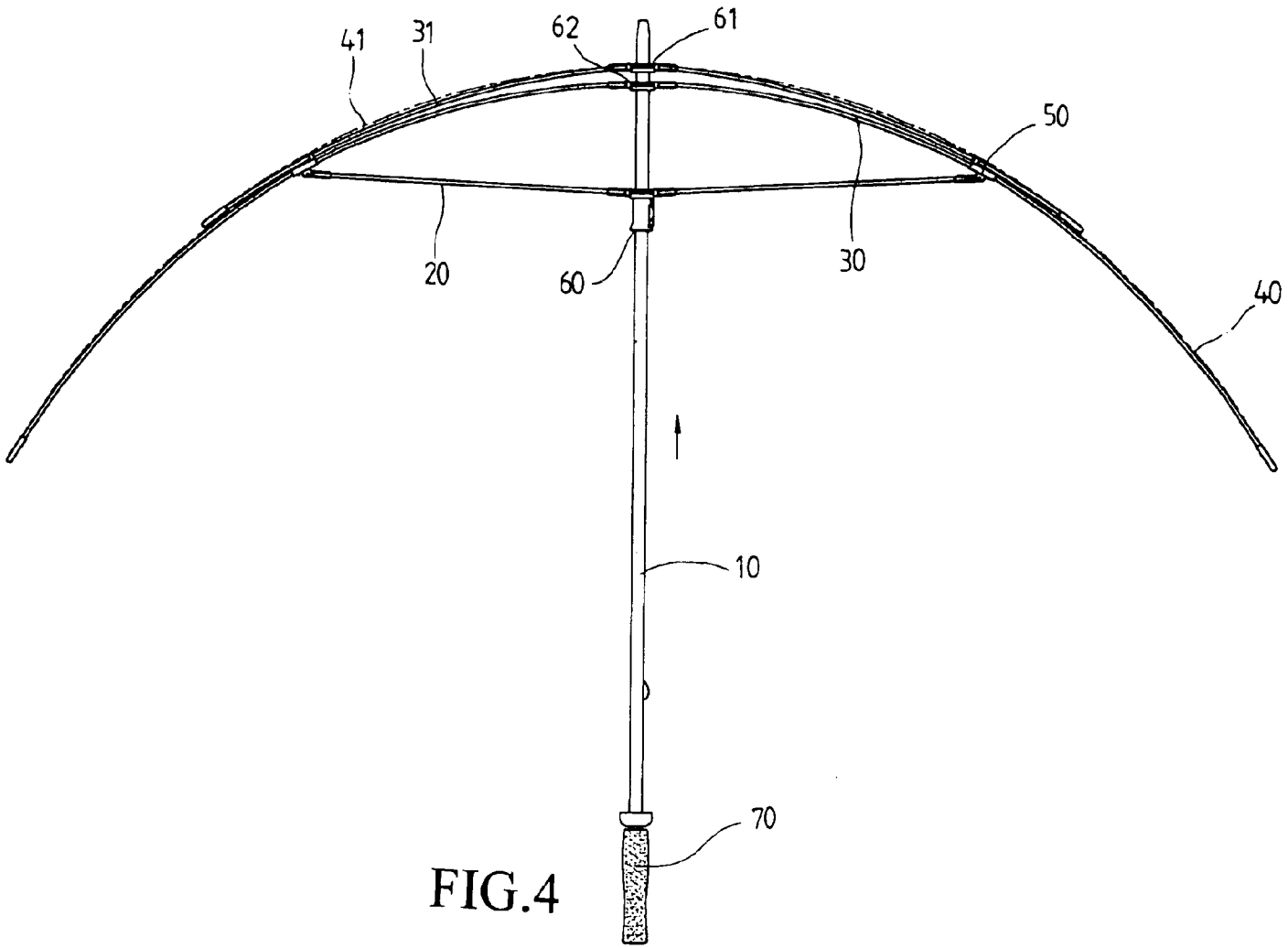
FIG. 4 shows the umbrella of the present invention in a stretched status.
Figure 5:
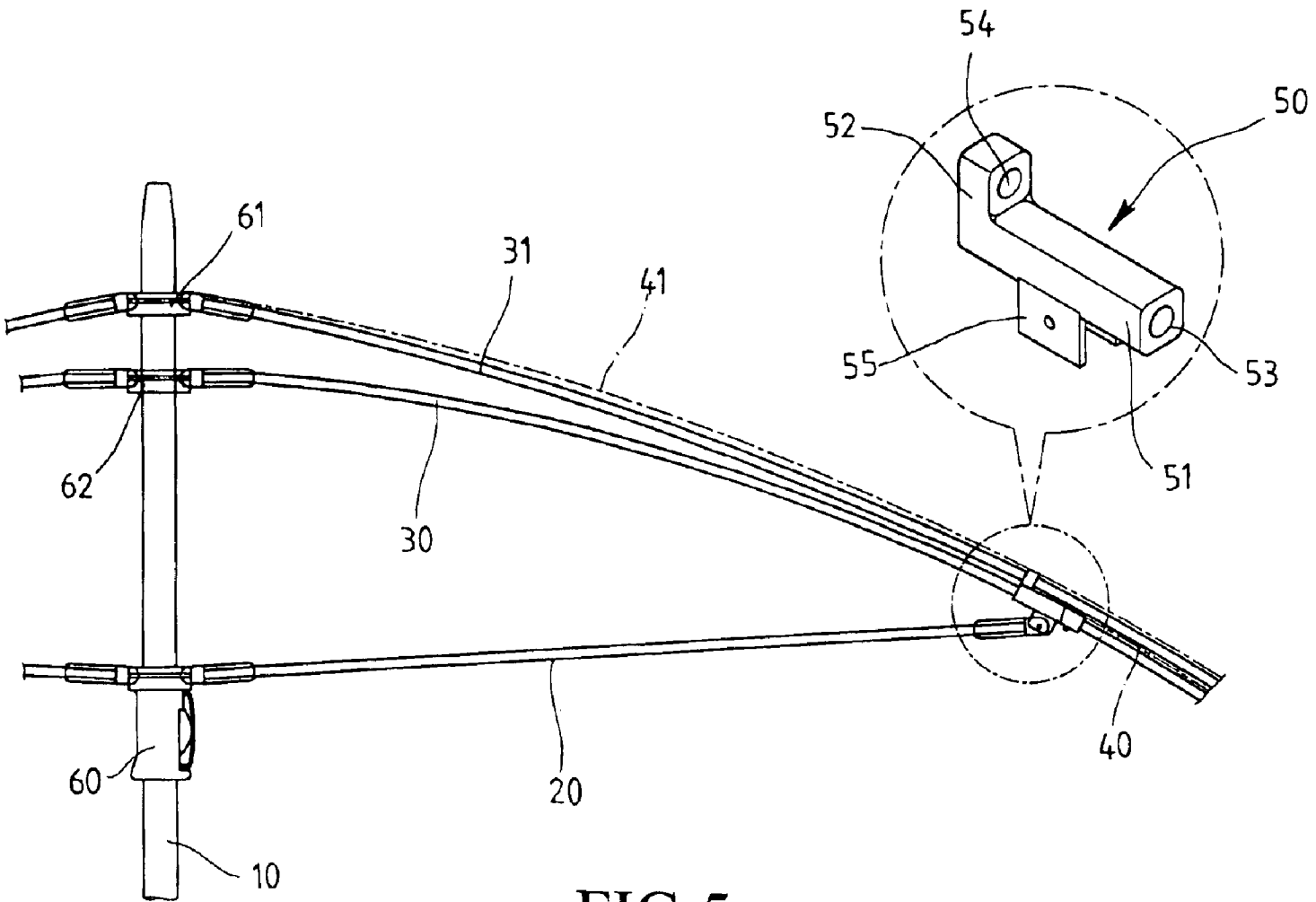
FIG. 5 is an enlarged view to show the joint to which the first ribs and the second ribs connected.

Referring to FIGS. 3 to 5, the umbrella of the present invention comprises a shaft 10 having a handle 70 connected to a first end thereof and a runner 60 is movably mounted to the shaft 10. A first cap 61 and a second cap 62 are respectively connected to a second end of the shaft 10, wherein the first cap 61 is located closer than the second cap 62 to the second end of the shaft 10.

A plurality of first ribs 30 each have a first end pivotably connected to the second end cap and each first rib 30 has a joint 50 connected thereto. The joint 50 includes an elongate body 51 with a first passage 53 defined therethrough and the first rib 30 extends through the first passage 53 of each of the joints 50. A protrusion 52 extends from a top of an end of the joint 50 and a second passage 54 is defined through the protrusion 52. A plurality of second ribs 31 each have a first end thereof pivotably connected to the first cap 61 and a second end of the second rib 31 movably extends through the second passage 54 of each joint 50.

Figure 9:
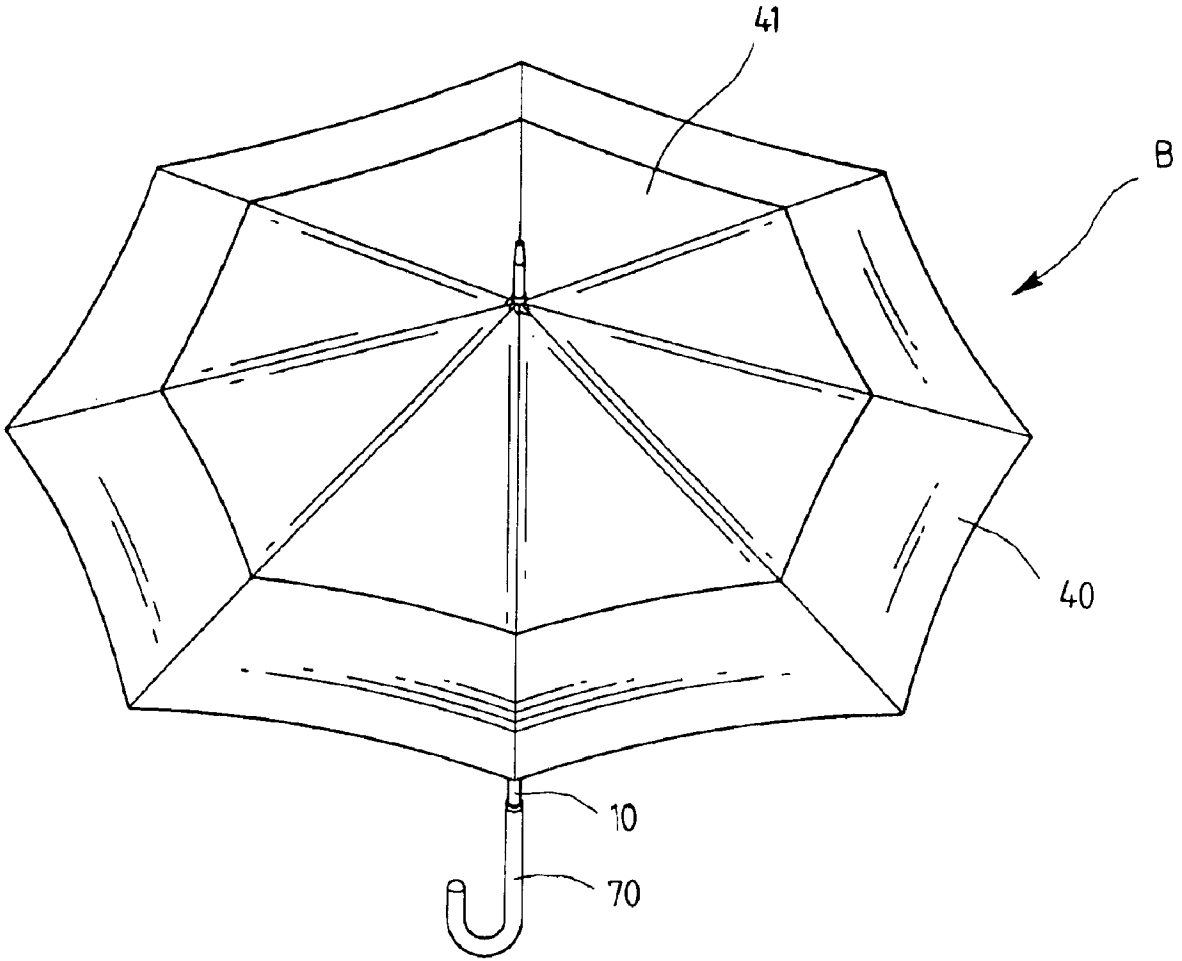
FIG. 9 shows a top view if the umbrella of the present invention.

A main panel 40 is attached to the first ribs 30 and the main panel 40 is a ring-shaped panel so as to define a hole with a center at the shaft 10. A section of the second end of each of the second ribs 31 are overlapped on the main panel 40 and a sub-panel 41 is attached to the second ribs 31 and covers the hole in the main panel 40 as shown in FIG. 9. A plurality of stretchers 20 are pivotably connected between the runner 60 and the joints 50, wherein each of the joints 50 includes two lugs 55 between which an end of the stretcher 20 corresponding thereto is pivotably connected.

Figure 6:
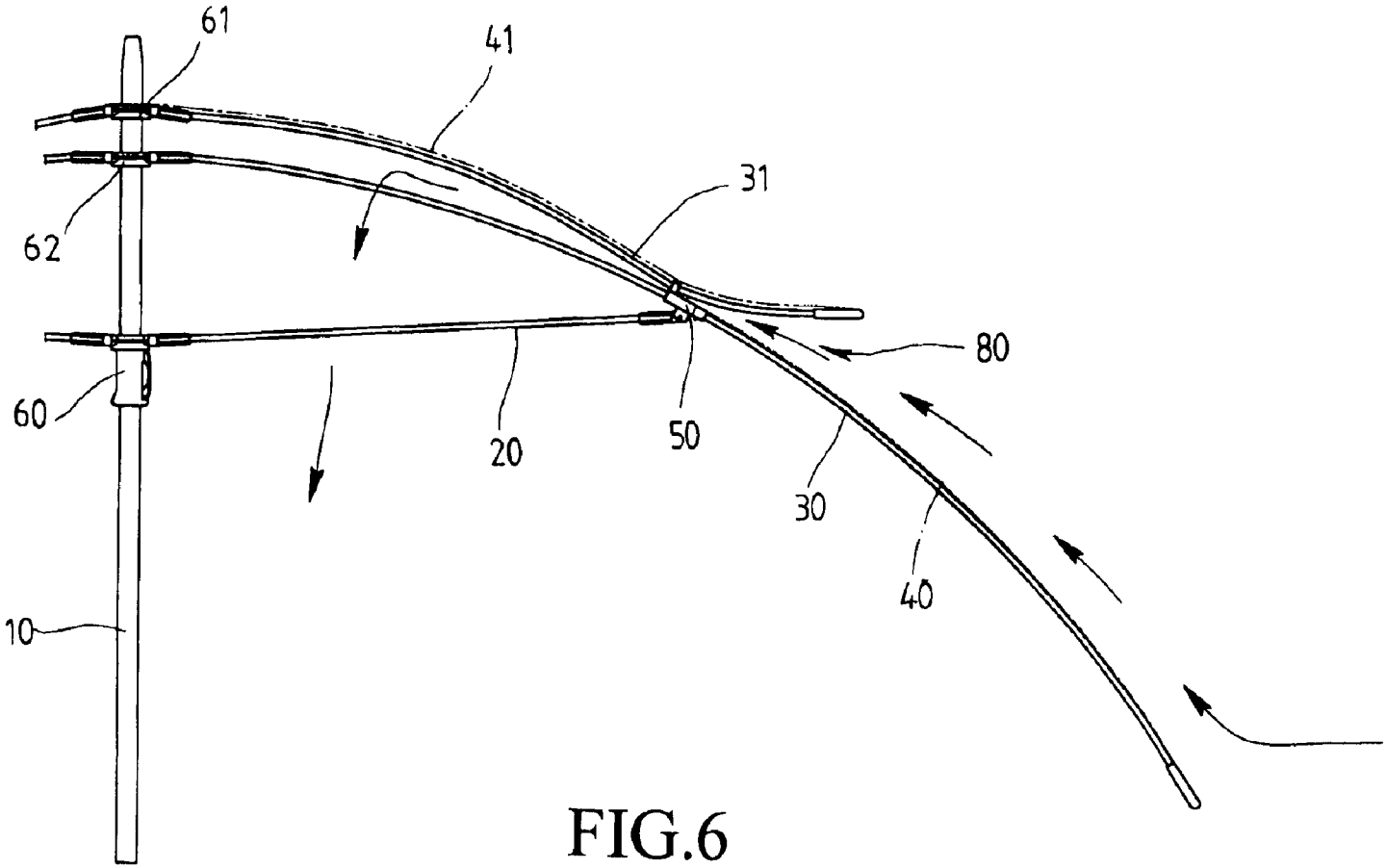
FIG. 6 shows wind flows beneath the sub-panel and enters through the hole of the main panel.

As shown in FIG. 6, when the wind flows on a top surface of the main panel 40, the wind goes beneath the sub-panel 41 and then enters the hole of the main panel 40. By this way, the force applied to the main panel 40 can be reduced. It is to be noted that the second ribs 31 can be deformed slightly while the hole is still covered.

Figure 7:
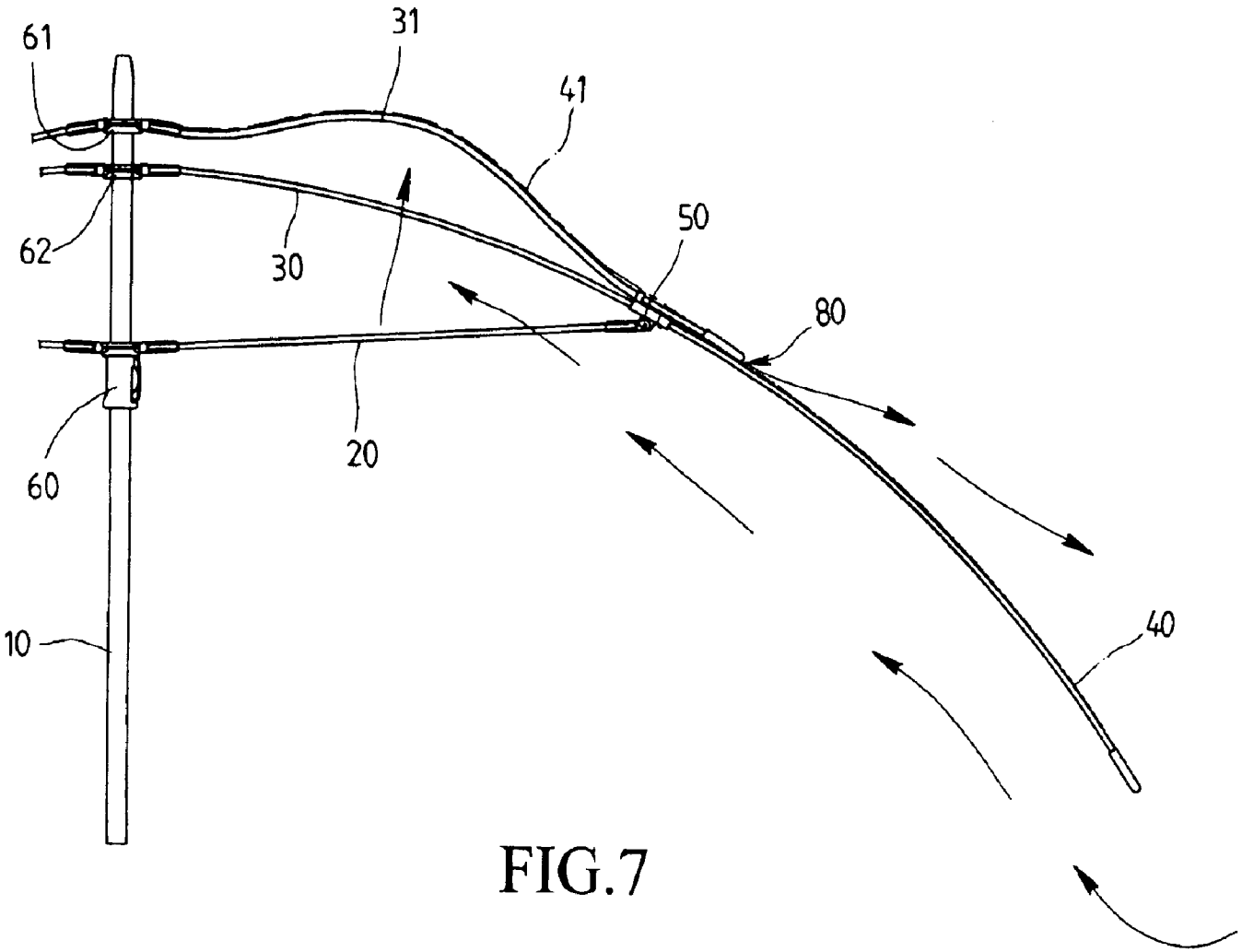
FIG. 7 shows wind flows through the hole of the main panel and passes beneath the sub-panel.

As shown in FIG. 7, if the wind blows from an underside of the main panel 40, the wind will go through the hole of the main panel 40 and releases through space between the main panel 40 and the sub-panel 41.

Figure 8:
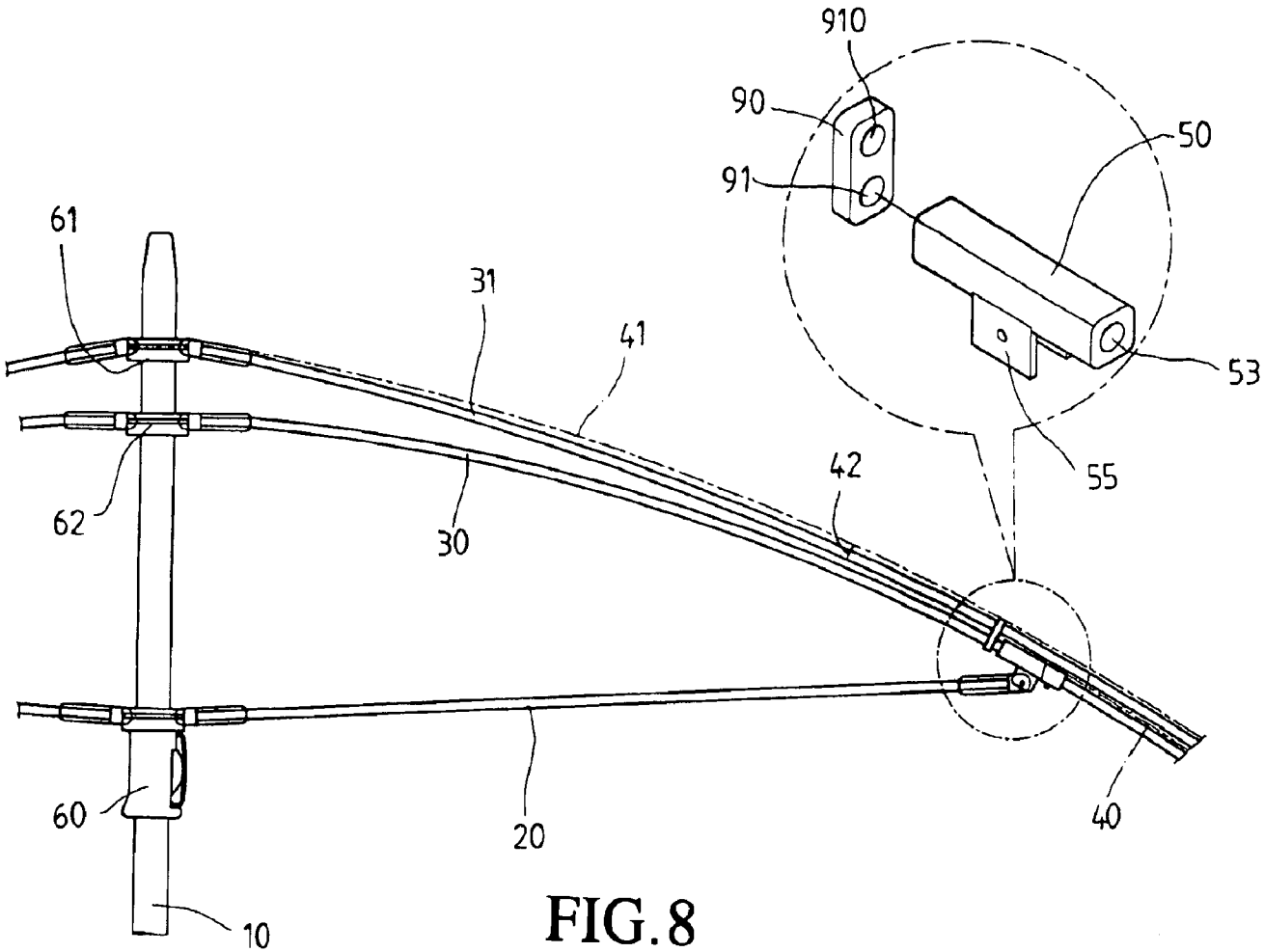
FIG. 8 shows another embodiment of the joint.

As shown in FIG. 8 which discloses another embodiment of the joint 50 which includes is composed of an elongate body 50 and a block 90 which is located in separate from the elongate body 50. The first passage 53 is defined through the elongate body 50 and the block 90 includes a through hole 91 through which the first rib 40 extends and, the second passage 910 through which the second rib 31 extends. The block 90 is located between the elongate body 50 and a connection position 42 where the sub-panel 41 is secured to the second ribs 31.

The two-layer panel design efficiently releases the pressure cause by wind to the umbrella so as to avoid the ribs of the umbrella from bending upward.

While we have shown and described the embodiment in accordance with the present invention, it should be clear to those skilled in the art that further embodiments may be made without departing from the scope of the present invention.

What is claimed is:

1. An umbrella comprising:

a shaft having a handle connected to a first end thereof, a runner movably mounted to the shaft;

a first cap and a second cap connected to a second end of the shaft, the first cap located closer than the second cap to the second end of the shaft;

a plurality of first ribs each having a first end pivotally connected to the second end cap and each first rib having a joint connected thereto, each joint having a first passage and a second passage, the first rib extending through the first passage, a plurality of second ribs each having a first end thereof pivotally connected to the first cap and a second end of each of the second ribs movably extending through the second passage, a main panel attached to the first ribs and having a hole with a center at the shaft, a section of the second end of each of the second ribs being overlapped on the main panel and a sub-panel attached to the second ribs and covering the hole in the main panel, and a plurality of stretchers pivotally connected between the runner and the joints, each of the joints including two lugs between which an end of a corresponding one of the plurality of stretchers is pivotally connected.

2. An umbrella comprising:

a shaft having a handle connected to a first end thereof, a runner movably mounted to the shaft;

a first cap and a second cap connected to a second end of the shaft, the first cap located closer than the second cap to the second end of the shaft;

a plurality of first ribs each having a first end pivotally connected to the second end cap and each first rib having a joint connected thereto, each joint having a first passage and a second passage, the first rib extending through the first passage, each of the joints includes an elongate body with the first passage defined therethrough and a protrusion extending from a top of an end of the joint and the second passage being defined through the protrusion, a plurality of second ribs each having a first end thereof pivotally connected to the first cap and a second end of each of the second ribs movably extending through the second passage, a main panel attached to the first ribs and having a hole with a center at the shaft, a section of the second end of each of the second ribs being overlapped on the main panel and a sub-panel attached to the second ribs and covering the hole in the main panel; and a plurality of stretchers pivotally connected between the runner and the joints.

3. An umbrella comprising:

a shaft having a handle connected to a first end thereof, a runner movably mounted to the shaft;

a first cap and a second cap connected to a second end of the shaft, the first cap located closer than the second cap to the second end of the shaft;

a plurality of first ribs each having a first end pivotally connected to the second end cap and each first rib having a joint connected thereto, each joint having a first passage and a second passage, the first rib extending through the first passage, a plurality of second ribs each having a first end thereof pivotally connected to the first cap and a second end of each of the second ribs movably extending through the second passage, a main panel attached to the first ribs and having a hole with a center at the shaft, a section of the second end of each of the second ribs being overlapped on the main panel and a sub-panel attached to the second ribs and covering the hole in the main panel, each of the joints being composed of an elongate body and a block which is located separate from the elongate body, the first passage defined through the elongate body, the block including a through hole through which the first rib extends and the second passage through which the second rib extends; and a plurality of stretchers pivotally connected between the runner and the joints.

4. The umbrella as claimed in claim 3, wherein the block is located between the elongate body and a connection position where the sub-panel is secured to the second ribs.

* * * * *